US008363081B2

(12) United States Patent
Shukuya

(10) Patent No.: US 8,363,081 B2
(45) Date of Patent: Jan. 29, 2013

(54) IMAGE FORMING APPARATUS FOR CORRECTING SUB-SCANNING MISALIGNMENT OF BEAMS ON A PHOTOCONDUCTOR

(75) Inventor: Yuichiro Shukuya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/027,357

(22) Filed: Feb. 15, 2011

(65) Prior Publication Data

US 2011/0205324 A1 Aug. 25, 2011

(30) Foreign Application Priority Data

Feb. 19, 2010 (JP) ..... 2010-034406

(51) Int. Cl.
*B41J 2/47* (2006.01)
*B41J 2/435* (2006.01)

(52) U.S. Cl. ..... 347/234; 347/235; 347/248; 347/250

(58) Field of Classification Search ..... 347/243, 347/234–235, 248, 250
See application file for complete search history.

(56) References Cited

U.S. PATENT DOCUMENTS

| | | | | |
|---|---|---|---|---|
| 6,002,413 | A | 12/1999 | Nishizawa et al. | |
| 7,493,072 | B2 | 2/2009 | Sato et al. | |
| 7,770,998 | B2 | 8/2010 | Shinohara et al. | |
| 2008/0204842 | A1 * | 8/2008 | Arai et al. | 359/204 |
| 2008/0232833 | A1 * | 9/2008 | Shukuya | 399/38 |

FOREIGN PATENT DOCUMENTS

| | | | |
|---|---|---|---|
| JP | 07228000 | A * | 8/1995 |
| JP | 3164002 | | 5/2001 |
| JP | 2008-070801 | | 3/2008 |
| JP | 2008-070802 | | 3/2008 |

* cited by examiner

*Primary Examiner* — Stephen Meier
*Assistant Examiner* — Sarah Al Hashimi
(74) *Attorney, Agent, or Firm* — IPUSA, PLLC

(57) ABSTRACT

An image forming apparatus forms a latent image on a photoconductor by irradiating light beams from a plurality of light sources onto the photoconductor. A detection unit detects a time difference between timings of start writing on the photoconductor by the light beams in a main scanning direction. A calculation unit calculates a shift of each of the light beams in a sub-scanning direction based on the time difference detected by the detection unit and a rotation speed of the photoconductor. A correction unit corrects irradiated positions on the photoconductor by the light beams in the sub-scanning direction based on the shift calculated by the calculation unit.

12 Claims, 7 Drawing Sheets

Pa : WRITE POSITION OF FIRST LD
Pb : IDEAL WRITE POSITION OF SECOND LD
Pb' : WRITE POSITION OF SECOND LD

IMAGE FORMING APPARATUS FOR CORRECTING SUB-SCANNING MISALIGNMENT OF BEAMS ON A PHOTOCONDUCTOR

BACKGROUND OF THE INVENTION

1. Field of the Invention

The present invention relates to an image forming apparatus having an optical scanner.

2. Description of the Related Art

Conventionally, there is an image forming apparatus that can correct a color shift in a sub-scanning direction on a photoconductor based on a timing at which a rotation reference position of the photoconductor is detected and an angular velocity of the photoconductor. Such an image forming apparatus is disclosed, for example, in Japanese Laid-Open Patent Application No. 2008-70802.

In such a conventional image forming apparatus, it is difficult to correct a sub-scanning misalignment of each of laser beams irradiated onto a photoconductor. The sub-scanning misalignment is generated due to a variation in a pitch (may be referred to as a beam pitch) of the laser beams in a sub-scanning direction caused by a difference in write-start timings of the laser beams. Thus, the conventional image forming apparatus has a problem in that a sub-scanning misalignment during an image forming operation cannot be corrected.

SUMMARY OF THE INVENTION

It is a general object of the present invention to provide an improved and useful image forming apparatus in which the above-mentioned problem is eliminated.

A more specific object of the present invention is to provide a technique to correct a sub-scanning misalignment with high accuracy during an image forming operation.

In order to achieve the object, there is provided according to one aspect of the present invention an image forming apparatus configured to form a latent image on a photoconductor by irradiating light beams from a plurality of light sources onto the photoconductor, the image forming apparatus comprising: a detection unit configured to detect a time difference between timings of start writing on the photoconductor by the light beams in a main scanning direction; a calculation unit configured to calculate a shift of each of the light beams in a sub-scanning direction based on the time difference detected by the detection unit and a rotation speed of the photoconductor; and a correction unit configured to correct irradiated positions on the photoconductor by the light beams in the sub-scanning direction based on the shift calculated by the calculation unit.

There is provided according to another aspect of the invention an image forming apparatus configured to form a latent image on a photoconductor by irradiating light beams from a plurality of light sources onto the photoconductor, the image forming apparatus comprising: detecting means for detecting a time difference between timings of start writing on the photoconductor by the light beams in a main scanning direction; calculating means for calculating a shift of each of the light beams in a sub-scanning direction based on the time difference detected by the detecting means and a rotation speed of the photoconductor; and correcting means for correcting irradiated positions on the photoconductor by the light beams in the sub-scanning direction based on the shift calculated by the calculating means.

There is provided according to another aspect of the present invention a misalignment correcting method of correcting a misalignment of positions irradiated by light beams from a plurality of light sources on a photoconductor of an image forming apparatus in a sub-scanning direction, the method comprising: a step of detecting a time difference between timings of start writing on the photoconductor by the light beams in a main scanning direction; a step of calculating a shift of each of the light beams in a sub-scanning direction based on the time difference detected by the detecting step and a rotation speed of the photoconductor; and a step of correcting irradiated positions on said photoconductor by the light beams in the sub-scanning direction based on the shift calculated by the calculating step, wherein the correction by the correcting step is performed in a process of assembling the image forming apparatus.

According to the above-mentioned image forming apparatus and misalignment correcting method, a sub-scanning misalignment can be corrected with high accuracy during an image forming operation by correcting the sub-scanning misalignment between light beams caused by a difference in the write-start timings of the plurality of light beams.

Other objects, features and advantages of the present invention will become more apparent from the following detailed description when read in conjunction with the accompanying drawings.

DETAILED DESCRIPTION OF THE PREFERRED EMBODIMENTS

A description will be given below, with reference to the drawings, of embodiments of the present invention.

Figure 1:
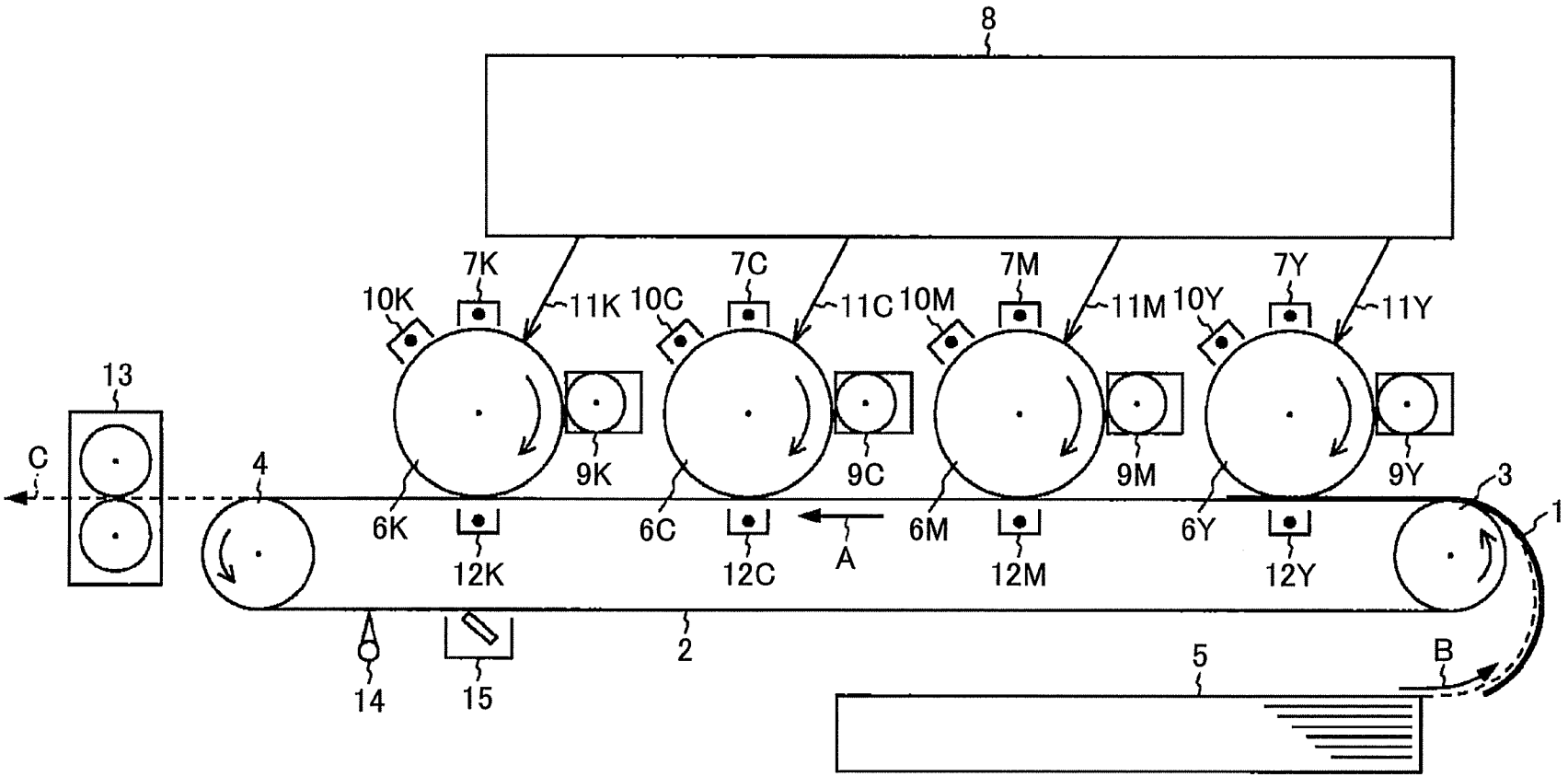
FIG. 1 is a view illustrating a structure of an image forming apparatus according to an embodiment of the present invention.

FIG. 1 is a diagram of an image forming apparatus according to an embodiment of the present invention. The structure illustrated in FIG. 1 is common to first through fourth embodiments mentioned below. The image forming apparatus illustrated in FIG. 1 is an example of an image forming apparatus such as, for example, a facsimile apparatus, a printer, a copy machine and a multi-function peripheral.

In the image forming apparatus, image forming parts for forming images of various different colors (yellow: Y, magenta: M, cyan: C, black: K) are arranged on a line along a conveyance belt 2, which conveys a transfer paper 1 (may be referred to as "print paper" or "recording material").

The conveyance belt 2 is provided between conveyance rollers including a drive roller 3, which is driven to rotate, and a driven roller 4, which is freely rotatable, so that the conveyance belt 2 is driven to rotate in a direction indicated by an arrow A in the figure by a rotation of the conveyance rollers.

A paper feed tray 5 accommodating a plurality of transfer papers 1 is provided under the conveyance belt 2. The transfer paper 1 at the uppermost position from among the plurality of transfer papers 1 accommodated in the paper feed tray 5 is fed in a direction indicated by an arrow B in the figure, and is attached to the conveyance belt 2 by an electrostatic attraction force.

The transfer paper 1 attached to the conveyance belt 2 is conveyed to a first image forming part where a yellow image formation is performed. The first image forming part includes a photoconductor drum 6Y and a charger 7Y, an exposure unit 8, a developer 9Y and a photoconductor cleaner 10Y that are arranged around the photoconductor drum 6Y.

The surface of the photoconductor drum 6Y is uniformly charged by the charger 7Y. Thereafter, the surface of the photoconductor 6Y is exposed by the exposure unit 8 using a laser beam 11Y corresponding to a yellow image so that a latent image of a yellow portion is formed on the surface of the photoconductor drum 6Y.

The electrostatic latent image formed on the photoconductor drum 6Y is developed by the developer 9Y, and the developed yellow tonner image is formed on the photoconductor drum 6Y. The yellow toner image is transferred onto the transfer paper 1 by a transfer unit 12Y at a position (transfer position) where the transfer paper 1 on the conveyance belt 2 is brought into contact with the photoconductor drum 6Y so that the yellow image of a single color is formed on the transfer paper 1.

The photoconductor drum 6Y after the transfer of the toner image is completed is subject to cleaning by the photoconductor cleaner 10Y to remove an unnecessary toner remaining on the surface of the photoconductor drum 6Y in order to prepare for a next image formation.

The transfer paper 1, on which the yellow toner image of a single color has been formed by the first image forming part, is conveyed by the conveyance belt 2 to a second image forming part, which forms a magenta image. In the second image forming part, the magenta toner image formed on a photoconductor drum 6M is transferred onto the transfer paper 1 in the same manner as the yellow toner image mentioned above.

Thereafter, the transfer paper 1 is conveyed sequentially to a third image forming part and a fourth image forming part so that a cyan toner image and a black toner image are sequentially transferred onto the transfer paper 1 in the same manner as the yellow toner image to form a full color image.

Then, the transfer paper 1 passed through the fourth image forming part and the full color image formed thereon is separated from the conveyance belt 2, and the full color image on the transfer paper 1 is fixed by a fixing unit 13 and the transfer belt 1 is ejected onto a paper eject tray (not illustrated in the figure) located in a direction indicated by an arrow C.

Additionally, a detection sensor unit 14 is provided to the conveyance belt 2 to detect positioning patterns and process control patterns formed on the conveyance belt 2. The positioning patterns and process control patterns formed on the conveyance belt 2 are removed by a cleaning unit 15 after the detection of the patterns by the detection sensor unit 14 is ended. The cleaning unit 16 also removes the residual toner on the conveyance belt 2 during an image forming operation.

A description will be given below of a detection of process control patterns and positioning patterns for each color formed on the conveyance belt 2 in the image forming apparatus according to the present embodiment.

Figure 2:
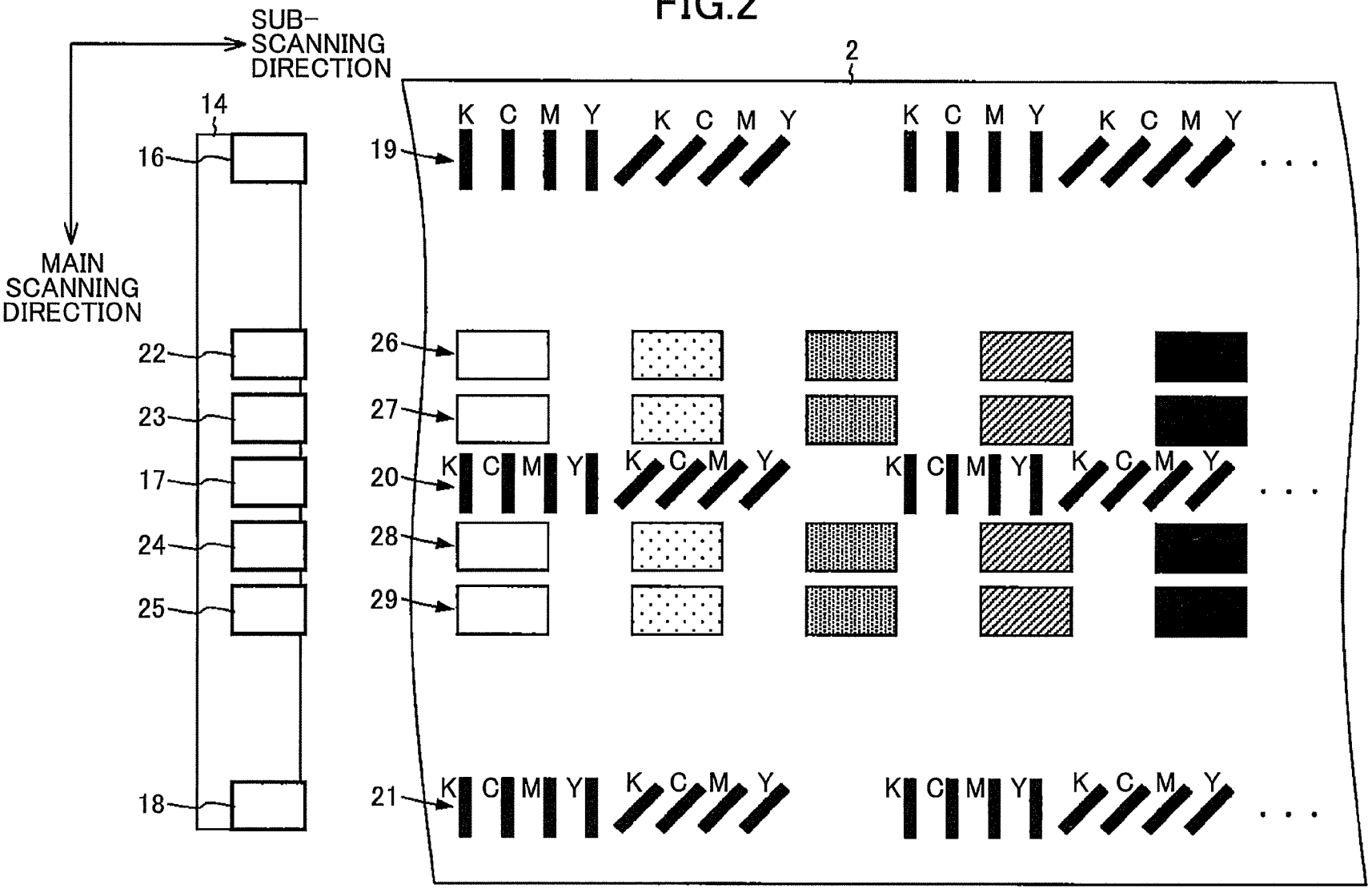
FIG. 2 is an illustration indicating a correspondence relationship between process control patterns, positioning patterns and detection sensor units.

FIG. 2 is an illustration indicating a correspondence relationship between the process control patterns and the positioning patterns for each color formed on the conveyance belt 2 illustrated in FIG. 1.

Three positioning-pattern detection sensors 16, 17 and 18 are attached on a detection sensor unit 14 by being arranged in the main scanning direction. The positioning-pattern detection sensors 16, 17 and 18 detect the positioning patterns 19, 20 and 21, which are formed and arranged on the conveyance belt 2 in three rows to correspond to the positioning pattern detection sensors 16, 17 and 18, respectively. A CPU mentioned later performs a positioning control process based on detection results of the positioning patterns 19, 20 and 21.

Four process control pattern detection sensors 22, 23, 24 and 25 are attached to the detection sensor unit 14 in order to detect process control patterns 26, 27, 28 and 29, which are also formed and arranged on the conveyance belt 2 in four rows. The process control patterns 26 through 29 are patterns arranged in parallel and in black (K), cyan (C), magenta (M) and yellow (Y). The process control pattern detection sensors 22 through 25 detect the process control patterns 26 through 29, which are formed and arranged at positions corresponding to the process control pattern detection sensors 22 through 25 on the conveyance belt 2, respectively. A CPU mentioned later performs a process control process based on the detection results of the process control patterns 26 through 29. That is, the CPU mentioned later executes a process of calculating the above-mentioned misalignment and an amount of correction, and issues a correction execution command.

According to a positioning control process performed by the CPU mentioned later, a skew, a sub-scanning registration shift, a main scanning registration shift and a main scanning magnification error with respect to a reference color (for example, the positioning pattern of black (K)) can be measured based on the detection results of the positioning patterns 19, 20 and 21. The CPU performs a correction process for each error based on the results of measurements.

That is, it is possible to correct an amount of shift in position due to a magnification error in the main scanning direction by shifting an image in a direction opposite to the direction of the position shift by a previously set amount (for example, an amount of ½) of a maximum position shift amount detected by the positioning-pattern detection sensors 16, 17 and 18 so that the amount of shift in position due to the magnification error in the main scanning direction is less visible.

Additionally, according to the positioning control process, a sub-scanning line skew (curve) can also be detected based on the results of detection of the patterns at three positions formed on the conveyance belt 2 at a predetermined interval in the main scanning line. Thus, the sub-scanning registration correction can be optimized with higher accuracy by correcting the thus-detected sub-scanning line skew.

On the other hand, in the process control process, a predetermined operation is performed based on the results of detection of the process control pattern detection sensors 22 through 25 in order to change process conditions for processes such as a charge process of the photoconductor drums 6Y, 6M, 6C and 6K, a development process of the electrostatic latent images on the photoconductor drums 6Y, 6M, 6C and 6K, a transfer process of the toner images on the photoconductor drums 6Y, 6M, 6C and 6K to a transfer paper 1, etc.

The above-mentioned positioning control process and the above-mentioned process control process may be executed by an instruction by a user menu or a service menu of the image forming apparatus or a printer driver operating in an information processing apparatus, which causes the image forming apparatus to perform printing.

Moreover, the above-mentioned positioning control process and the above-mentioned process control process may be performed automatically when a predetermined execution condition is established in the image forming apparatus. The predetermined execution condition includes a condition established when a power of the image forming apparatus is turned on, a condition established when a number of printed sheets is accumulated in the image forming apparatus, a condition established when a result of detection of a temperature sensor (not illustrated in the figure) provided at a predetermined location in the image forming apparatus rises to a predetermined temperature. It should be noted that, in a case of an image forming apparatus adopting an intermediate transfer system, the above-mentioned patterns may be formed on an intermediate transfer belt.

Figure 3:
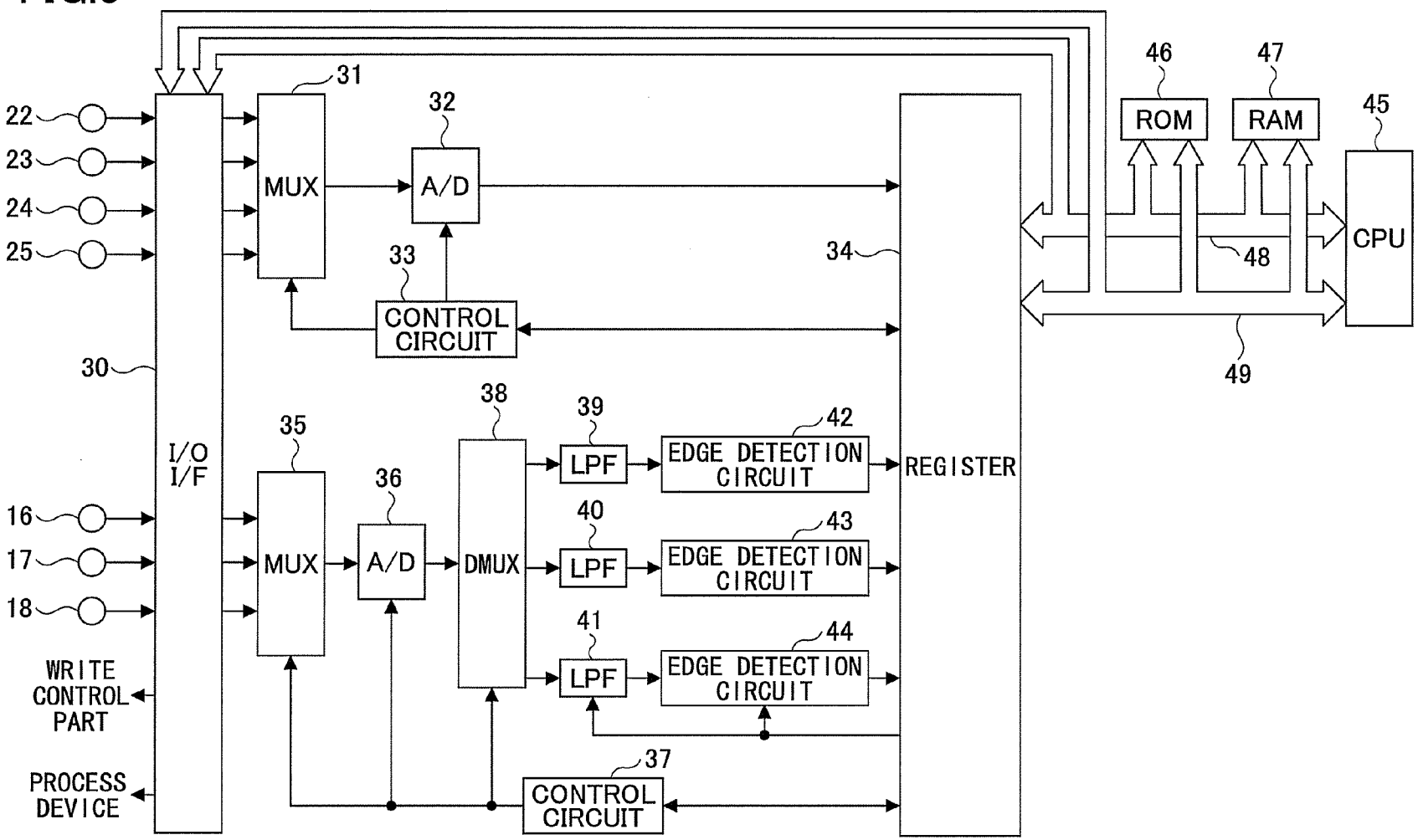
FIG. 3 is a block diagram of a control part of the image forming apparatus illustrated in FIG. 1.

A description is given below of a structure of a control part of the image forming apparatus according to the present embodiment. FIG. 3 is a functional block diagram illustrating a structure of a control part, which performs the positioning control process and process control process.

The control part is incorporated in the image forming apparatus illustrated in FIG. 1. As illustrated in FIG. 3, an input/output interface (I/O I/F) 30 and a CPU 45, a ROM 46 and a RAM 47 are connected through an address bus 48 and a data bus 49 so that data exchange can be performed therebetween. Detected voltages output from the process control pattern detection sensors 22 through 25 are input to a multiplexer (MUX) 31 through the I/O I/F 30.

The MUX 31 and an analog-digital converter (A/D) 32 operate under a control of the control circuit 33 only during a detection of the process control patterns. The MUX 31 sequentially selects a sensor channel (ch) of each of the process control pattern detection sensors 22 through 25, and sequentially outputs the detected voltages input from the process control pattern detection sensors 22 through 25 to the A/D 32. The A/D 32 converts the detected voltages output from the MUX 31 from analog values into digital values, and outputs the digital data corresponding to the detected voltage to the register 34. The digital data is stored in the register 34.

The CPU receives the digital data stored in the register 34 through the data bus 49. Then, the CPU 45 sends various instructions to the I/O I/F 30 through the buses 48 and 49. The various instructions include an instruction to change a process condition of charging the photoconductor drums 6Y, 6M, 6C and 6K, an instruction to change a process condition of developing electrostatic latent images on the photoconductor drums 6Y, 6M, 6C and 6K, and an instruction to change a process condition of transferring toner images on the photoconductor drums 6Y, 6M, 6C and 6K to the transfer paper 1. The I/O I/F 30 outputs the instructions to a processing apparatus. The processing apparatus changes the process condition of charging the photoconductor drums 6Y, 6M, 6C and 6K, the process condition of developing electrostatic latent images on the photoconductor drums 6Y, 6M, 6C and 6K, and the process condition of transferring toner images on the photoconductor drums 6Y, 6M, 6C and 6K to the transfer paper 1.

On the other hand, the detection voltages output from the positioning pattern detection sensors 16, 17 and 18 are input to a multiplexer 35 through the I/O I/F 30. The MUX 35 and an analog-digital converter (A/D) 36 operate under a control of a control circuit 37 only during a detection of the positioning patterns. The MUX 35 sequentially selects a sensor channel (ch) of each of the positioning pattern detection sensors 16, 17 and 18, and sequentially outputs the detected voltages input from the positioning pattern detection sensors 16, 17 and 18 to the A/D 36. The A/D 36 converts the detected voltages output from the MUX 35 from analog values into digital data, and outputs the digital data corresponding to the detected voltages to a demultiplexer (DMUX) 38.

The DMUX 38 outputs the digital data to low-pass filters (LPFs) 39, 40 and 41 provided for each channel (ch) of the positioning pattern detection sensors 16, 17 and 18, respectively. Each of the LPFs 39, 40 and 41 can be a digital filter circuit or a product-sum operation circuit.

For example, the digital data corresponding to the detected voltage output from the positioning pattern detection sensor 16 is output to the LPF 39, the digital data corresponding to the detected voltage output from the positioning pattern detection sensor 17 is output to the LPF 40, and the digital data corresponding to detected voltage output from the positioning pattern detection sensor 16 is output to the LPF 41. Each of the LPFs 39, 40 and 41 removes a high-frequency component from the digital data, and outputs the digital data to a respective one of edge detection circuits 42, 43 and 44. By removing a high-frequency component from the detected values of the positioning pattern sensors 16, 17 and 18, a more accurate recognition of positions of the patterns can be achieved in a circuit of a subsequent stage.

The edge detection circuits 42, 43 and 44, which are subsequent stages of the LPFs 39, 40 and 41, compare detected voltage waveforms of the digital data output from the LPFs 39, 40 and 41 with threshold values, respectively, in order to extract rising/falling points in the waveforms. In this process, a point at which the voltage drops below a threshold value is extracted as a falling point (an edge portion 1 of the pattern), and, then, a point at which the voltage rises higher than a threshold value is extracted as a rising point (an edge portion 2 of the pattern). Thereafter, data of a pattern middle position indicating a middle position between the points is sent to and stored in the register 34.

Then, the CPU 45 stores the data stored in the register 34 in the RAM 47 by following a procedure indicated by a program stored in the ROM 46. Then, the CPU 45 performs a process condition changing operation and a positioning operation in order to set the process control and the positioning to the write control part and the processing apparatus through the I/O I/F 30 based on the results of the operations. Additionally, the CPU 45 causes the control circuits 33 and 37 to perform a control operation such as start and stop of sampling and switching of sensor channels for A/D conversion. Further, the CPU 45 changes a cutoff frequency of each of the LPFs 39, 40 and 41, and sets the threshold voltage of each of the edge detection circuits 42, 43 and 44.

Figure 4:
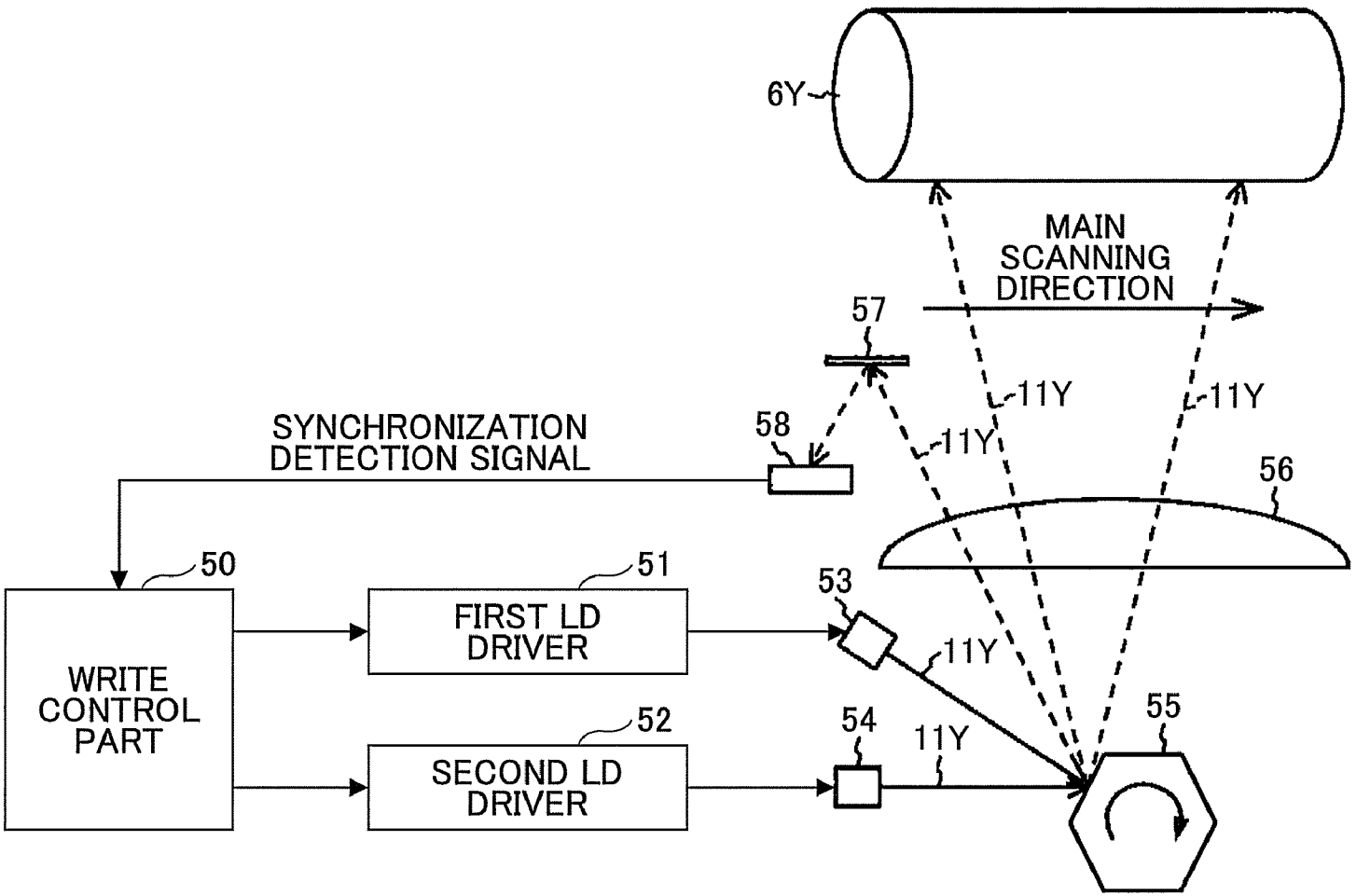
FIG. 4 is a diagram illustrating a structure of an exposure illustrated in FIG. 1.

A description will be given below of a structure of the exposure unit 8 of the image forming apparatus according to the present embodiment. FIG. 4 is a diagram illustrating a structure of the exposure unit 8 illustrated in FIG. 1.

In the image forming apparatus according to the present embodiment, the exposure unit 8 is configured to perform writing using laser beams (light beams) emitted by two laser light sources (light-emitting elements) for each color. That is, the exposure unit 8 forms an electrostatic latent image by alternately irradiating laser beams 11Y emitted from a first LD 53 and a second LD 54, which are the two laser light sources, onto the photoconductor drums 6Y through 6K. It should be noted that the following description is directed to a writing operation of a yellow image to the photoconductor drum 6Y. Because the writing operations to other photoconductor drums 6M, 6C and 6K are the same as that of the photoconductor drum 6Y, descriptions thereof will be omitted.

In the exposure unit 8, a write control part 50 is realized by a microcomputer configured by a CPU, a ROM and a RAM. The write control part 50 controls a first LD driver 51 and a second LD driver 52 in order to emit laser beams 11Y from the first LD 53 and the second LD 54. The laser beams 11Y are incident on and reflected by a reflection surface of a polygon mirror 55, which is rotated by a polygon motor (not illustrated in the figure) in a direction of arrow in the figure. The beams reflected by the surface of the polygon mirror 55 are deflected by the rotation of the polygon mirror 55. The deflected beams pass through an fθ lens 56 and form exposure lines extending in a direction indicated by arrow in the figure on the outer surface of the photoconductor drum 6Y.

The laser beams 11Y deflected by the polygon mirror 55 are first reflected by a mirror 57 arranged outside an image area (outside the photoconductor drum 6Y), and are incident on a synchronization detection part (may be referred to as "synchronization detection plate"), which is also arranged outside the image area. The synchronization detection part 58 detects the incident laser beams 11Y, and outputs a synchronization detection signal, which is a reference of a write start position in a write control in the main scanning operation on the surface of the photoconductor drum 6Y, to the write control part 50.

The write control part 50 outputs image data to each of the first LD driver 51 and the second LD driver 52 at a main scanning write start timing according to the synchronization detection signal received from the synchronization detection part 58 as a reference. The first LD driver 51 and the second LD driver 52 control turning on and off of the first LD 53 and the second LD 54, respectively, in response to the image data sent from the write control part 50. Then, the first LD 53 and the second LD 54 irradiate the laser beams 11Y, respectively, onto the photoconductor drum 6Y in the main scanning direction. The laser beam 11Y emitted from the first LD 53 forms an Nth line of the main scanning lines on the photoconductor drum 6Y, and the laser beam 11Y emitted from the second LD 54 forms an (N+1)th line of the main scanning lines on the photoconductor drum 6Y (N=0, 2, 4, 8, . . . ). As mentioned above, an electrostatic latent image for a yellow part of the image is formed on the charged photoconductor drum 6Y by the laser beams 11Y irradiated by the first LD 53 and the second LD 54.

Figure 5A:
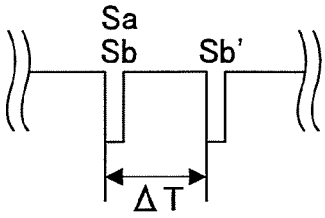
FIG. 5A is an illustration of a main scanning write timing.
Figure 5B:
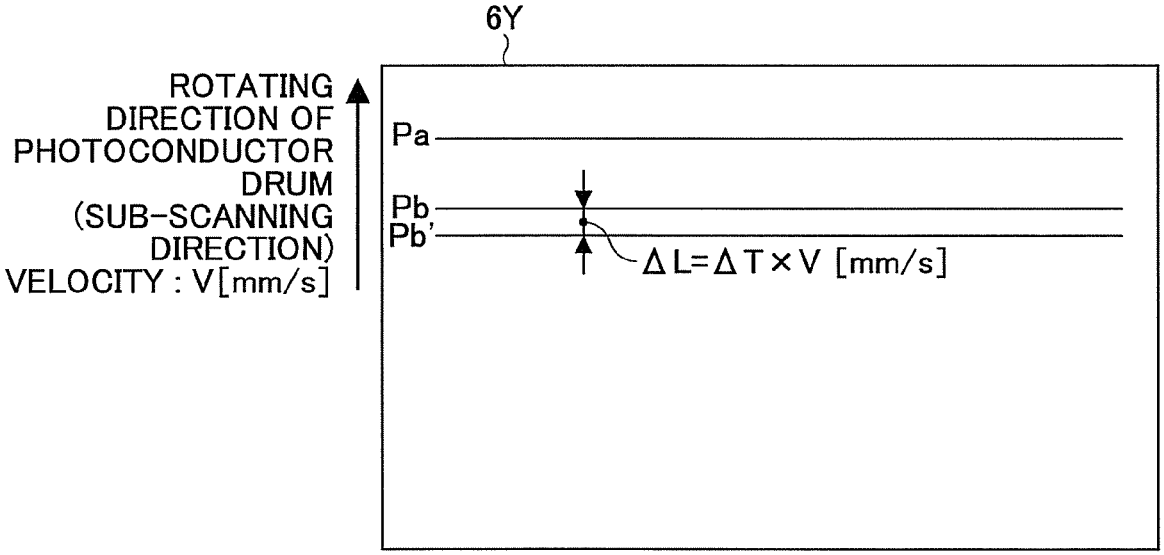
FIG. 5B is an illustration for explaining a sub-scanning misalignment.

A description will be given below of a sub-scanning misalignment generated due to a difference in main scanning write start timings of laser beams emitted from a plurality of laser light sources. FIGS. 5A and 5B are illustrations for explaining a sub-scanning misalignment generated due to a difference in main scanning write start timings.

If, for example, the synchronization detection signal explained above with reference to FIG. 4 is used to determine a main scanning write start timing of the laser beam 11Y of each of the first LD 53 and the second LD 54, a difference or a delay may be generated in timings of the laser beams 11Y of the first LD 53 and the second LD 54 reaching the synchronization detection part 58 depending on a relationship between mount positions of the first LD 53 and the second LD 54 relative to the exposure unit 8 and an angular position of the rotating polygon mirror 55. In such a case, in the write control part 50, there is a time delay in receiving the synchronization detection signals from the synchronization detection part 58, which synchronization detection signals are based on the laser beams 11Y of the first LD 53 and the second LD 54.

For example, as illustrated in FIG. 5A, it is ideal that the synchronization detection signals based on the laser beams 11Y of the first LD 53 and the second LD 54 are received simultaneously by the write control part 50 as indicated by Sa and Sb in the figure. However, there may be a time difference ΔT [sec] generated between the synchronization detection signal Sa based on the laser beam 11Y of the first LD 53 and the synchronization detection signal Sb based on the laser beam 11Y of the second LD 54 because the timing of receiving the synchronization detection signal Sb may be delayed as mentioned above.

If such a time difference ΔT is generated, because the photoconductor drum 6Y is already rotating, a write start position Pb' of the laser beam 11Y of the second LD 54 is shifted by a shift amount ΔL [mm] from an ideal write start position Pb of the laser beam 11Y of the second LD 54 when there is no delay in receiving the laser beam 11Y of the second LD 54. Thus, the time difference ΔT is generated from a time when a write operation by the laser beam 11Y of the first LD 53 is started until a time when a write operation by the laser beam 11Y of the second LD 54 is started.

The above-mentioned time difference ΔT [sec] is determined by the positional relationship between the mount positions of the first LD 53 and the second LD 54 relative to the exposure unit 8 and the geometrical position of the synchronization detection part 58. If the rotating speed of the photoconductor drum 6Y, which is a linear velocity of the outer circumference of the photoconductor drum Y, is V [mm/sec], the above-mentioned shift amount ΔL [mm] is acquired by an operation based on the following formula 1 using the linear velocity V [mm/sec] and the time difference ΔT [sec]

$$\Delta L = \Delta T \times V \quad \text{(formula 1)}$$

Thus, when drawing a latent image of a single color on the photoconductor drum 6Y by the laser beams 11Y of the first LD 53 and the second LD 54, the shift amount ΔL appears as a sub-scanning misalignment (a beam pitch shift) between the laser beam 11Y of the first LD 53 and the laser beam 11Y of the second LD 54, thereby causing deterioration of image quality when printing the image on the transfer paper 1. Moreover, if, for example, the first LD 53 and the second LD 54 are laser light sources for different colors from each other, the above-mentioned shift amount ΔL appears as a sub-scanning misalignment for each color image, which causes deterioration of color image quality.

EXAMPLE 1

Case 1 of Correction Between Different Colors

In the above-mentioned image forming apparatus, if the first LD 53 and the second LD 54 are light sources for irradiating lights for forming latent images for different colors on the photoconductor drum, the above-mentioned shift amount ΔL can be corrected by the positioning control process explained with reference to FIG. 2 and FIG. 3. The shift amount ΔL, in combination with other causes of a color shift, appears as a shift amount in the positioning patterns 19, 20 and 21. Thus, the shift amount ΔL is included in a sub-scanning misalignment detected from the positioning patterns 19, 20 and 21. Thus, by performing the positioning control process by the CPU 45, the shift amount ΔL can be corrected with respect to the beam irradiation positions of the laser beams of the first LD 53 and the second LD 54.

EXAMPLE 2

Case 2 of Correction Between Different Colors

There is a case where the first LD 53 and the second LD 54 are light sources for forming latent images for different color images on the photoconductor drum. In such a case, in order to reduce a down time in the image forming apparatus, execution of the above-mentioned positioning control process may be limited to one of a plurality of print modes. In such an image forming apparatus, a correction value at a linear velocity at which a color alignment correction is performed is converted and used for other linear velocities/print modes. In some image forming apparatuses, there may be a case where the linear velocity of the photoconductors 6Y through 6K is changed during an image forming operation in response to a paper type of the transfer paper 1 (regular paper, thin paper, thick paper, etc.) and a print mode. In such a case, the rotation speed of the polygon mirror 55 must be changed in response to the change in the linear velocity of the photoconductor drums 6Y through 6K, and a number of laser light sources may be changed. Thus, there is a possibility that the shift amount ΔL is changed for each linear velocity or each mode. In such an image forming apparatus, the correction of the shift amount ΔL may be reflected only in a regular paper mode. Moreover, as mentioned above, the shift amount ΔL cannot be fixed in the image forming apparatus having a plurality of linear velocities/print modes. Thus, in order to perform an appropriate correction for each linear velocity/print mode, the shift amount ΔL may be calculated for each of the linear velocities/print modes because the linear velocities/print modes of an image forming apparatus are known. Then, the image forming apparatus is provided with correspondence table information in which shift amounts ΔL are defined in relation to the linear velocities/print modes. The correspondence table information may be stored in the ROM 46 or the RAM 47 so that the CPU 45 performs an appropriate correction in response to each linear velocity/print mode by referring to the correspondence table information.

Figure 6:
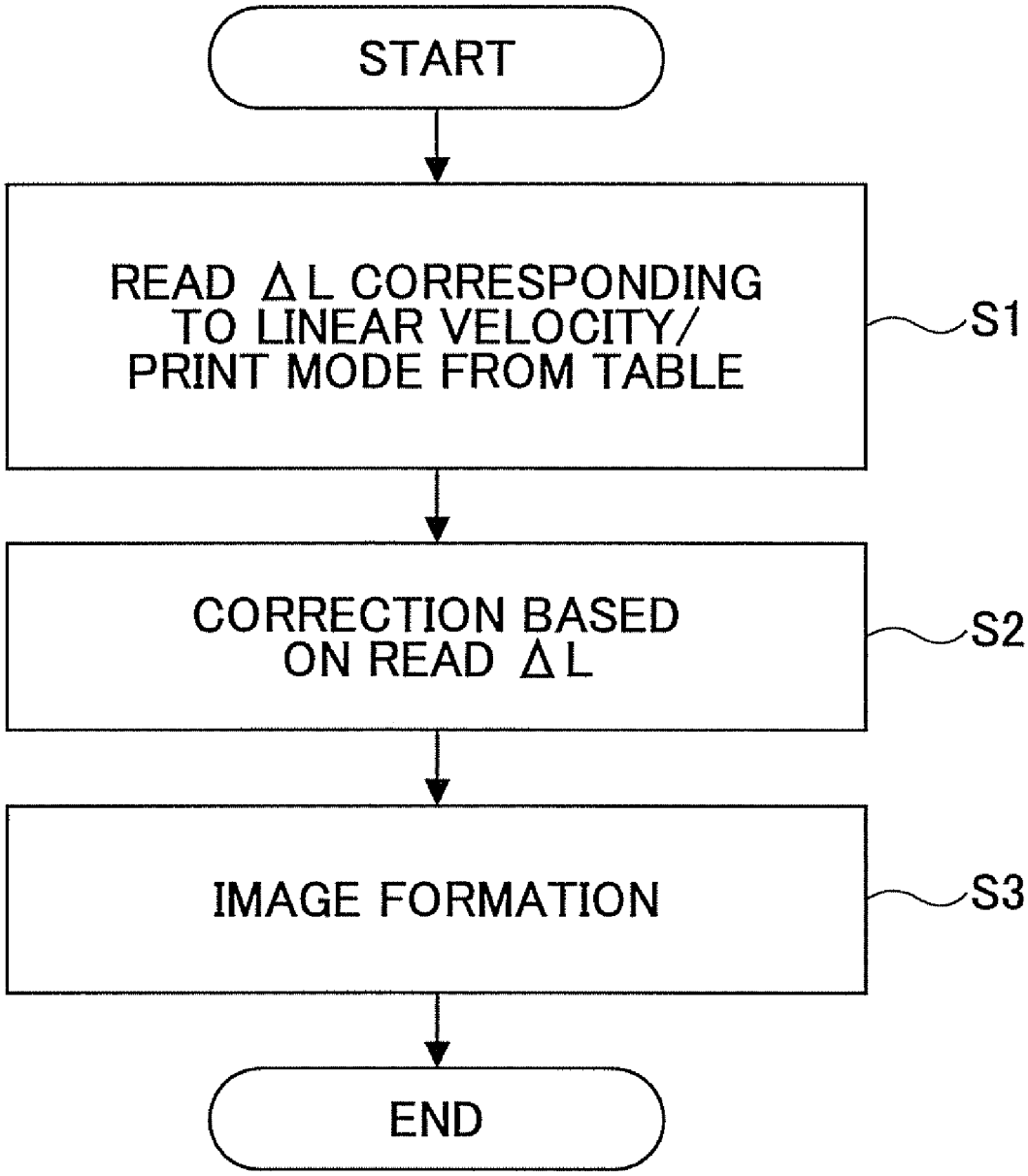
FIG. 6 is a flowchart of a process of correcting a sub-scanning misalignment performed by a CPU illustrated in FIG. 3.

FIG. 6 is a flowchart of a sub-scanning misalignment correction process performed by the CPU 45. The CPU 45 reads, in step S1, the shift amount ΔL corresponding to a linear velocity/print mode from the correspondence table information. Then, in step S2, the CPU 45 performs a correction process of correcting the irradiation positions of the laser beams 11Y of the first LD 53 and the second LD 45 in the sub-scanning direction based on the read shift amount ΔL. Thereafter, in step S3, the CPU 45 controls each part of the information forming apparatus to perform an image forming operation to form an image, and, then, the sub-scanning misalignment correction process is ended.

EXAMPLE 3

Case 1 of Correction within the Same Color

In the above-mentioned image forming apparatus, an image is formed on the photoconductor drum 6Y by the two laser diodes, which are the first LD 53 and the second LD 54. In this case, the shift amount ΔL appears as a variation or a fluctuation in an interval (beam pitch) between the laser beams 11Y in the sub-scanning direction in the formed image. The beam pitch of the laser beams in the sub-scanning direction is originally adjusted to match the sub-scanning write resolution. However, as explained with reference to FIGS. 5A and 5B, if the laser beams are shifted from the ideal write positions (target values) in the sub-scanning direction, a variation or fluctuation is generated in the beam pitch of the laser beams in the sub-scanning direction, which generates an image intensity unevenness or bundling in the latent image on the photoconductor drum 6Y. This may also happen in other photoconductor drums 6M, 6C and 6K. Thus, an adjustment is performed, when assembling the exposure unit 8 to the image forming apparatus, in consideration of the above-mentioned shift amount ΔL.

A description is given below of an adjusting method in which the shift amount ΔL is taken into consideration. Although the following description is directed to the photoconductor drum 6Y and the first LD 53 and the second LD 54, the same adjusting method is applicable to other photoconductor drums 6M, 6C and 6K and laser diodes irradiating laser beams thereon, and descriptions thereof will be omitted.

Figure 7:
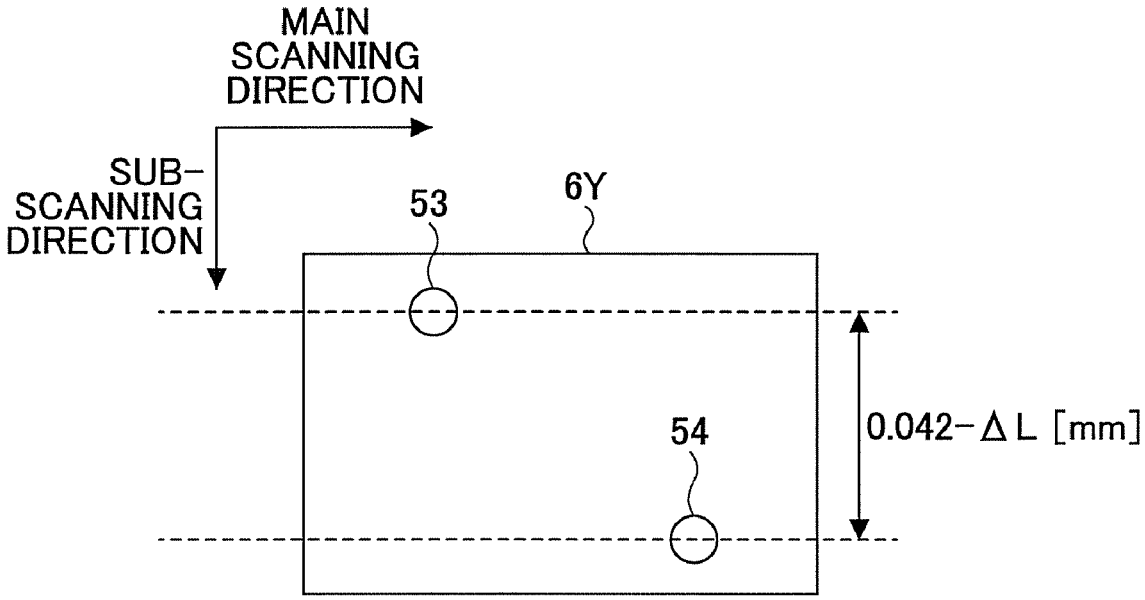
FIG. 7 is an illustration of positions of a first LD and a second LD illustrated in FIG. 4.

First, the beam pitch of the laser beams of the first LD 53 and the second LD 54 in the sub-scanning direction is adjusted to correspond to the sub-scanning write resolution. FIG. 7 is an illustration indicating a positional relationship between the first LD 53 and the second LD 54 and the photoconductor drum 6Y illustrated in FIG. 4. If, for example, the sub-scanning write resolution in the sub-scanning direction is 600 dpi, an adjustment is made so that the interval between the laser beam from the first LD 53 and the laser beam from the second LD 54 on the photoconductor drum 6Y is set to 0.042 [mm] (25.4 [mm]/1200×1000=0.042 [mm]). This adjustment method can be performed by fine adjustment of mount angles of the first LD 53 and the second LD 54 to the exposure unit 8.

When performing the above-mentioned adjustment, the sub-scanning misalignment, which is caused by a difference between main scanning write start timings, can be corrected by taking the shift amount ΔL into consideration. That is, the correction method according to the correction means of the present embodiment is performed in the assembly process of the image forming apparatus.

Additionally, if the sub-scanning write resolution is 600 dpi, a beam pitch unevenness due to the shift amount ΔL can be eliminated by adjusting the mount angles of the first LD 53 and the second LD to the exposure unit 8 so that the interval between the laser beam from the first LD 53 and the laser beam of the second LD 54 on the photoconductor drum 6Y is set to (0.042−ΔL) [mm].

EXAMPLE 4

Case 2 of Correction within the Same Color

In a case where the image forming apparatus has a plurality of linear velocities/print modes, if the shift amount ΔL takes a different value for each mode, the adjustment at the time of assembly is not sufficient for the correction of the sub-scanning misalignment. Thus, the sub-scanning misalignment is corrected by deflecting a traveling direction of each laser beam by a sub-scanning deflection means. The sub-scanning deflection means is provided between the laser beam emitting side of each of the laser diodes and the photoconductor drum in order to deflect the traveling direction of each laser beam independently.

Figure 8:
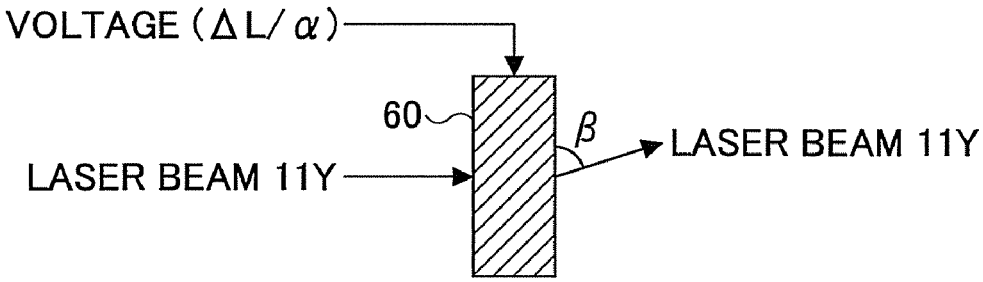
FIG. 8 is an illustration of a liquid crystal deflection element, which is an example of a sub-scanning deflection means provided in the exposure unit illustrated in FIG. 1.

FIG. 8 is an illustration of a liquid crystal deflection element, which is an example of the sub-scanning deflection means provided in the exposure unit 8 illustrated in FIG. 1. The liquid crystal deflection element 60, which is an example of the sub-scanning deflection means, has a characteristic in which a refraction index thereof varies in response to a voltage applied thereto. Thus, the liquid crystal deflection element 60 is capable of deflecting an incident laser beam by refracting the incident laser beam by a refraction index determined by a voltage applied thereto.

For example, the liquid crystal deflection element 60 is provided between the laser beam emitting side of the second Lb 54 and the photoconductor drum 6Y, and a control part is provided to apply a voltage according to an instruction by the CPU 45 to the liquid crystal deflection element 60. Thus, the laser beam 11Y, which is emitted from the second LD 54 and incident on the liquid crystal deflection element 60, is deflected in a direction of an angle β at the exit by changing the voltage applied to the liquid crystal deflection element 60 by a value $\Delta L/\alpha$ [V], where α is a value representing a relationship between the voltage applied to the liquid crystal deflection element 60 and an amount of deflection in the sub-scanning direction on the photoconductor drum 6Y. Accordingly, the laser beam 11Y emitted from the second LD 54 can be irradiated at the ideal write position on the photoconductor drum 6Y by correcting sub-scanning misalignment of the laser beam 11Y from the second LD 54. Thus, a larger correction range within a limited correction range can be assigned to a shift amount due to other causes.

It is possible to combine the examples 1 and 2 and the examples 3 and 4. If the example 4 is combined, the sub-scanning misalignment caused by the time difference between the write start timings on the photoconductor drum may be adjusted by the sub-scanning deflection means, and the sub-scanning misalignment due to other causes (machine variations, inside temperature changes, part accuracy, etc.) may be corrected by the color alignment correction.

In the image forming apparatus according to the present embodiment, the sub-scanning misalignment caused by the time difference between the main scanning write timings of a plurality of laser diodes and linear velocities of the photoconductor drum is corrected. Thus, the misalignment between the laser beams can be corrected, which permits a high quality image being obtained.

The present invention is not limited to the specifically disclosed embodiments, and variations and modifications may be made without departing from the scope of the present invention.

The present application is based on Japanese priority application No. 2010-034406 filed on Feb. 19, 2010, the entire contents of which are incorporated herein by reference.

What is claimed is:

1. An image forming apparatus configured to form a latent image on a photoconductor by irradiating light beams from a plurality of light sources onto the photoconductor, the image forming apparatus comprising:

a detection unit configured to detect a time difference between timings of start writing on said photoconductor by the light beams generated by different laser diodes in a main scanning direction;

a calculation unit configured to calculate a shift of each of the light beams in a sub-scanning direction based on the time difference detected by said detection unit and a rotation speed of said photoconductor; and a correction unit configured to correct irradiated positions on said photoconductor by the light beams in the sub-scanning direction based on the shift calculated by said calculation unit.

2. The image forming apparatus as claimed in claim 1, wherein said laser diodes are configured to irradiate the light beams, respectively, to form latent images for different colors on said photoconductor.

3. The image forming apparatus as claimed in claim 1, wherein said laser diodes are configured to irradiate the light beams, respectively, to form latent images for the same color on said photoconductor.

4. The image forming apparatus as claimed in claim 1, wherein said correction unit includes a sub-scanning correction unit configured to correct the irradiated positions on said photoconductor by the light beams in the sub-scanning direction by deflecting traveling directions of the light beams based on the shift calculated by said calculation unit.

5. An image forming apparatus configured to form a latent image on a photoconductor by irradiating light beams from a plurality of light sources onto the photoconductor, the image forming apparatus comprising:

detecting means for detecting a time difference between timings of start writing on said photoconductor by the light beams generated by different laser diodes in a main scanning direction;

calculating means for calculating a shift of each of the light beams in a sub-scanning direction based on the time difference detected by said detecting means and a rotation speed of said photoconductor; and correcting means for correcting irradiated positions on said photoconductor by the light beams in the sub-scanning direction based on the shift calculated by said calculating means.

6. The image forming apparatus as claimed in claim 5, wherein said laser diodes are configured to irradiate the light beams, respectively, to form latent images for different colors on said photoconductor.

7. The image forming apparatus as claimed in claim 5, wherein said laser diodes are configured to irradiate the light beams, respectively, to form latent images for the same color on said photoconductor.

8. The image forming apparatus as claimed in claim 5, wherein said correcting means includes sub-scanning correcting means for correcting the irradiated positions on said photoconductor by the light beams by deflecting traveling directions of the light beams based on the shift calculated by said calculating means.

9. A misalignment correcting method of correcting a misalignment of positions irradiated by light beams from a plurality of light sources on a photoconductor of an image forming apparatus in a sub-scanning direction, the method comprising:

a step of detecting a time difference between timings of start writing on said photoconductor by the light beams generated by different laser diodes in a main scanning direction;

a step of calculating a shift of each of the light beams in a sub-scanning direction based on the time difference detected by said detecting step and a rotation speed of said photoconductor; and a step of correcting irradiated positions on said photoconductor by the light beams in the sub-scanning direction based on the shift calculated by the calculating step, wherein the correction by the correcting step is performed in a process of assembling said image forming apparatus.

10. The misalignment correcting method as claimed in claim 9, wherein said laser diodes irradiate the light beams, respectively, to form latent images for different colors on said photoconductor.

11. The misalignment correcting method as claimed in claim 9, wherein said laser diodes irradiate the light beams, respectively, to form latent images for the same color on said photoconductor.

12. The misalignment correcting method as claimed in claim 9, wherein the sub-scanning correcting step corrects irradiated positions by the light beams by deflecting traveling directions of the light beams based on the shift calculated by the calculating step.

* * * * *